US005201126A

United States Patent [19]

Tanel

[11] Patent Number: 5,201,126

[45] Date of Patent: Apr. 13, 1993

[54] CLEATED SOLE FOR AN ATHLETIC SHOE

[75] Inventor: Michael L. Tanel, Milwaukee, Wis.

[73] Assignee: Tanel Corporation, Milwaukee, Wis.

[21] Appl. No.: 741,042

[22] Filed: Aug. 6, 1991

Related U.S. Application Data

[63] Continuation of Ser. No. 407,869, Sep. 15, 1989, abandoned.

[51] Int. Cl.[5] ..... A43B 5/00; A43B 5/02

[52] U.S. Cl. ..... 36/134; 36/59 R; 36/67 R

[58] Field of Search ..... 36/134, 126, 128, 32 R, 36/59 C, 59 R, 67 R, 67 A

[56] References Cited

U.S. PATENT DOCUMENTS

| | | | |
|---|---|---|---|
| D. 294,655 | 3/1988 | Heyes | D2/320 |
| D. 295,231 | 4/1988 | Heyes | D2/320 |
| 3,581,414 | 6/1971 | Crawford | 36/59 R |
| 4,255,874 | 3/1987 | Sironi | D2/320 |
| 4,392,312 | 7/1983 | Crowley et al. | 36/126 |
| 4,501,077 | 2/1985 | Young | 36/32 R |
| 4,641,438 | 2/1987 | Laird et al. | D2/320 |
| 4,689,901 | 9/1987 | Ihlenburg | 36/126 |

FOREIGN PATENT DOCUMENTS

| | | | |
|---|---|---|---|
| 432510 | 3/1948 | Italy | 36/59 C |
| 224626 | 3/1943 | Switzerland | 36/59 R |
| 294324 | 11/1953 | Switzerland | 36/59 C |

*Primary Examiner*—Steven N. Meyers

*Attorney, Agent, or Firm*—Patrick J. Coyne; Kenneth M. Massaroni

[57] ABSTRACT

An improved athletic shoe sole of the type with annular cleating segments has an annular cleat set projecting from the main sole surface and disposed along a substantially circular path, the set having a plurality of cleat nodes each of which is arranged in a substantially abutting relationship to at least one adjacent cleat node. Each node has a distal end or tip spaced from the main sole surface and first and second edges on opposite sides of the distal end with proximal ends terminating on the circular path. Improved pivotability and traction characteristics are provided.

3 Claims, 3 Drawing Sheets

FIG-3
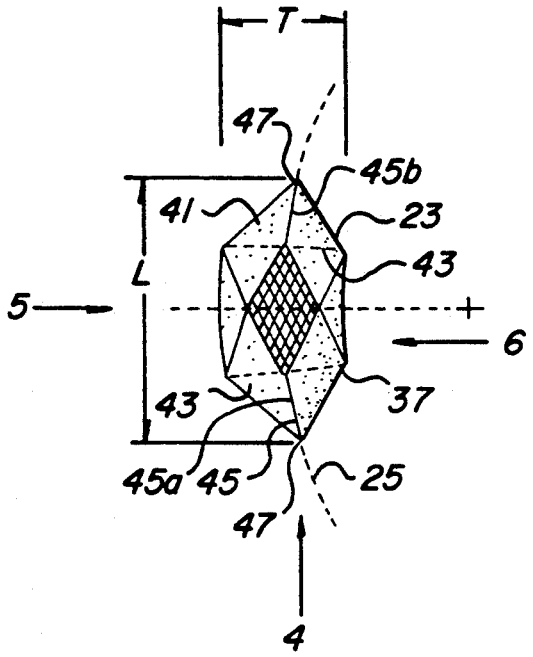
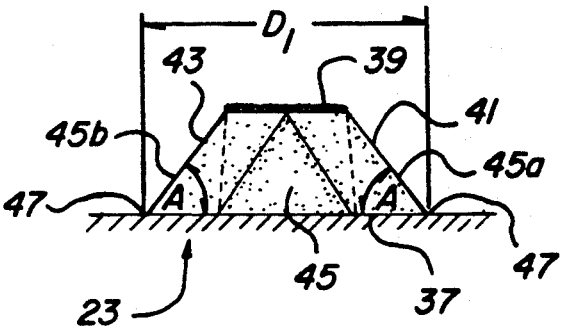
FIG-5
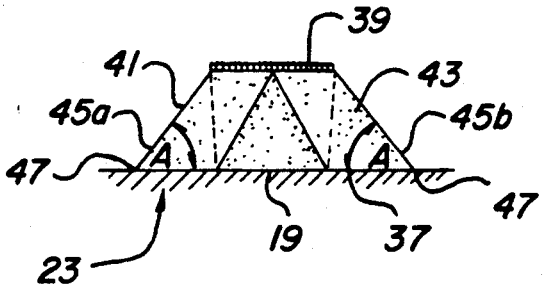
FIG-6
FIG-4
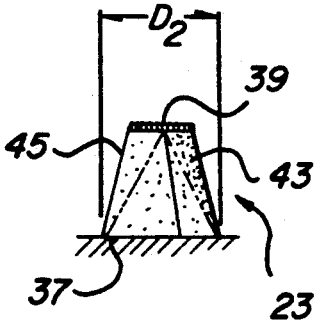
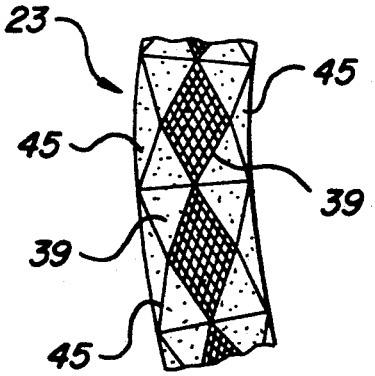
FIG-8

CLEATED SOLE FOR AN ATHLETIC SHOE

RELATED APPLICATION

This application is a continuation of patent application Ser. No. 407,869, which was filed on Sep. 15, 1989, by the applicant herein, and which is now abandoned.

FIELD OF THE INVENTION

This invention is related generally to athletic shoes of the type having cleats for penetrating ground engagement and, more specifically, to athletic shoes with cleats facilitating pivoting movement.

BACKGROUND OF THE INVENTION

Many athletic shoes used for field sports, such as football, soccer, lacrosse, baseball and softball, have a number of typically truncated cone-shaped cleats for the purpose of increasing traction. Cleats dig into the turf to prevent slipping during starting, stopping, and cutting maneuvers.

However, in addition to providing desirable traction for starting, stopping and cutting, such cleats typically provide very undesirable resistance to pivoting. This can be a disadvantage in at least two ways.

First, the resistance of many prior art cleating arrangements to turning movements can create stresses within the leg when unwanted torque or force is applied to the athlete, particularly to the athlete's leg. Injuries, particularly knee and ankle injuries, can result if a twisting movement is forcibly applied to a leg at a time when the cleats are firmly planted in the turf and release is difficult or impossible.

Second, when pivoting is inhibited, maneuverability of the athlete is limited, thus making performance less than it could be. Enhancing the ability of a player to pivot while still maintaining good traction and foot stability can greatly increase effectiveness on the field.

Recent athletic shoe cleating developments of Michael L. Tanel, the inventor herein, involving annular cleating provided a combination of greatly improved pivotability and excellent traction. These developments tend to reduce the chance of athletic injuries and significantly improve maneuverability on the field. Examples of such cleating are disclosed in U.S. Pat. Nos. 4,577,422, 4,653,206, 4,660,304, 4,669,204, 4,723,365 and 4,748,752.

The improvement in pivotability made possible with shoes in accordance with the principles of such patents is dramatic, and such shoes give the athletes wearing them a natural feeling of freedom together with good feeling of traction for stopping, starting and cutting.

Despite the improvements which these developments represent, additional improvement is needed to provide functional advantages not realized or fully realized in the prior art. Certain conditions and situations must be addressed and are addressed by the improvements of this invention.

One significant concern regarding cleated soles for athletic shoes, including those disclosed in the patents noted above, relates to the degree and ease of penetration of cleats. Ease of penetration has a significant effect on how well a shoe functions. If there is insufficient ground penetration or if ground penetration is difficult, there may be less traction than is desirable and less contact with the turf than is needed for the best possible fixed-position pivoting.

In this regard, consideration must be given to, among other things, the total area of the cleat ends, that is, the total area of the distal surface(s) of the cleat or cleats. Generally speaking, the greater the total end area bearing on the ground, the more difficult it may be for a cleat to penetrate the ground; the smaller the total end area bearing on the ground, the easier it may be for a cleat to penetrate. This effect is accentuated when the ground is hard.

Sharpening the distal end(s) of cleat(s), whether the shoe has discrete cleats or an annular cleat with an annular distal edge, tends to reduce the total area of cleat distal surface. However, it may also cause concern about injury from player contact with such sharp edges. This latter concern particularly arises in the cases of hard plastic or metal cleats.

Whether in pivoting motions or non-pivoting motions, maintenance of stability and traction is important under all conditions. Particular consideration must be given to the traction available from an athletic shoe sole when the wearer is playing on grassy turf with a very compact and hard underlying earth surface. Little if any earth penetration may be possible under such conditions, depending on the extent of turf hardness and compaction. The concern about hard ground under grassy turf is particularly significant when the grass is wet, as often occurs late in the evening or early in the morning because of dew.

The design of the sole can and should address such condition. When penetration is difficult, traction may depend in part on the extent of rubber "grab" on the ground and in part on the extent of "tangle" which is possible with the grass. When the grass is also wet, rubber "grab" is minimized and "tangle" becomes more important to an athlete's traction. Of course, the athlete does not wish to sacrifice pivotability under these conditions any more than he does under other turf conditions.

Another important consideration relates to the degree to which the underlying turf is destroyed when played upon by wearers of cleated shoes. With standard cleating arrangements, when pivoting occurs considerable ground or turf destruction can occur; that is, the turf may be ground up. This is not only harmful to the ground, but in itself causes a loss of foot traction. With an annular cleat, ground destruction is minimized, thus enhancing foot traction. There is a need to have the benefits of both sorts of cleats without unduly destroying turf.

While free pivotability is highly desirable, some athlete's would like there to be a degree of control in such pivotability. Providing a cleating arrangement with a modicum of initial resistance to pivoting would be regarded as desirable by some. However, generally free pivotability beyond that point is considered extremely important. Once again, there is a perceived need for some benefits of annular cleating combined with some benefits of old-style standard cleating arrangements.

Still another concern relates to the strength of cleats. Cleat bending and breakage can be a problem. It is considered very beneficial, of course, for cleats to be highly resistant to bending and breakage. Improvements in cleat structural strength are desirable.

In very soft ground, the lateral profile of some standard cleats of the prior art is sometimes too small to provide a sufficient level of resistance to through-ground sliding. Ground can be displaced when side pressure occurs, thus providing a failure of traction.

Providing cleats with greater resistance to such side pressure would be highly desirable.

Still another problem with certain cleated shoes of the prior art is that the pressure of the individual cleats can be felt by the foot of the athlete. Because of this, shoe comfort is reduced. The aforementioned annular cleats tend to overcome this problem, but for shoes with discrete cleats, this problem can be significant.

With all these things in mind, a few more specific observations concerning the prior art are in order.

Shoes like those disclosed in U.S. Pat. No. 4,689,901 (Ihlenburg) tend to have specific problems depending upon what material is used in cleat formation. If, on the one hand, the sole/cleat material is rubber or rubber-like in its surface characteristics and resiliency, such shoes are susceptible to the aforementioned problems of cleat bending and breakage because the cleats are of slight dimension (thin ridges) at positions too near the main sole surface, not to mention the problem of short life because of excessive early wearing-away of such material. If, on the other hand, the sole/cleat material is a hard synthetic material, such shoes, quite unlike shoes of rubber or rubber-like material, will be seriously deficient in their ability to engage certain playing surfaces.

At least one major manufacturer of cleated footwear has recognized such problems, particularly the problem of bending, breakage and excessive wearing-away of rubber or rubber-like cleat material. The Nike TM Shark TM shoe has spaced rubber or rubber-like cleats with substantial structural supports or ramping molded onto their inner sides to prevent bending, breakage and excessive wear. While such structure serves to prevent bending, breakage and excessive wear, such structure does not even begin to address many of the other problems and needs mentioned above, particularly those related to pivotability.

It was in this technical context and state of the art that the instant invention was made, overcoming all of the problems, conflicting and otherwise, which are discussed above.

A few general comments are in order before turning to a description of this invention. In particular, a brief description of the foot and its pivoting and planted positions will be helpful. This can serve as an aid in understanding preferred embodiments of this invention.

The sole of the foot includes four portions. These are, in order from back to front: the heel portion; the arch portion; the ball-of-the-foot portion; and the toe portion. The heel and ball-of-the-foot portions are those portions which share most if not all of the player's weight when the player is in a normal standing position with feet generally flat on the ground. In such position, the arch portion and toe portion bear little if any weight.

When a player is "on his toes" in a "ready" position, virtually all of the player's weight is normally shared by the toe portion and the ball-of-the-foot portion. The same is usually true when a player is "digging" in a running action. Indeed, when a player is in the ready position, the juncture of the phalanges (toe bones) and the metatarsals is the center of weight bearing. In other words, the center of weight bearing in the forward portions of the foot actually moves forward when a player shifts to the ready position.

The sole of an athletic shoe has portions immediately below these four portions of the foot which may be designated, and herein are designated, by the same terms.

OBJECTS OF THE INVENTION

It is an object of this invention to overcome some of the problems and shortcomings of the prior art, including those mentioned above.

Another object of this invention is to provide an improved athletic shoe sole.

Another object of this invention is to provide an athletic shoe having both improved pivotability and excellent traction.

Another object of this invention is to provide an improved athletic shoe which tends to reduce the risk of certain common injuries of athletes, particularly knee and ankle injuries.

Another object is to provide an improved athletic shoe of the type having annular cleating.

Another object of this invention is to provide an improved annular-cleated athletic shoe with enhanced ground penetration.

Still another object is to provide an athletic shoe sole exhibiting both good traction and pivoting characteristics on grass-covered hard earth, particularly when such grass is wet.

Another object is to provide an annular cleated athletic shoe exhibiting good traction and pivotability while also providing strong resistance to bending, breakage and excessive wearing-away of the cleat material.

Another object of this invention is to provide an athletic shoe with annular cleating which nevertheless exhibits good "tangle" traction with turf.

Yet another object is to provide an improved annular-cleated shoe having both excellent "grab" traction and excellent "tangle" traction.

Another object of this invention is to provide improved ground penetration in an annular-cleated shoe without sharpening the distal edge of annular cleating.

Another object is to provide an cleated athletic shoe combining certain benefits of standard cleating with certain benefits of annular cleating.

Another object is to provide an athletic shoe with improved ground penetrability which avoids or minimizes turf destruction and the resulting traction loss.

Another object of this invention is to provide an improved annular-cleated shoe with excellent pivotability which nevertheless provides what some perceive to be a desirable degree of initial resistance to pivoting.

Still another object of this invention is to provide a cleated athletic shoe having cleating with excellent strength and resistance to bending and breakage.

Another object of this invention is to provide an improved cleated shoe with wide cleat profile to avoid unnecessary through-ground sliding, thus enhancing stopping and starting traction.

Yet another object of this invention is to provide a cleated athletic shoe exhibiting excellent sole comfort.

These and other important objects will be apparent from the descriptions of this invention which follow.

SUMMARY OF THE INVENTION

This invention is an improved athletic shoe sole for field sports providing excellent controlled pivotability and traction in a commercially desirable form. The invention is an improvement in athletic shoe soles of the type having annular cleating.

The invention provides enhanced ground penetration, and resulting improvements in traction and pivotability. The sole of this invention also provides both good traction and pivoting characteristics on grass-covered hard earth, with significant improvement provided even when such grass is wet. Improved "tangle" and "grab" traction are provided in a sole of the type having annular cleating. Improved traction is provided without sharpening the distal edge of annular cleating. The soles of this invention minimize turf destruction even while providing excellent traction characteristics.

The soles of this invention, while having excellent pivoting characteristics, also provide what some perceive to be a desirable degree of initial resistance to pivoting. This gives an even greater feeling of control to some athletes. The cleating arrangement of this invention provide a wide cleat profile and thus avoid through-ground sliding. This enhances traction, particularly stopping and starting traction.

The soles of this invention are comfortable to wear, substantially avoiding any feeling of individual cleats as can occur with certain shoes of the prior art. The annular cleating of this invention also has excellent strength and resistance to bending and breakage. This is due in part to wide base dimensions.

The inventive sole has an annular cleat set which projects from the main sole surface and is disposed along a substantially circular path which encompassing a major area of the toe and ball-of-the-foot portions. The annular cleat set has a plurality of cleat nodes, each of which is arranged in a substantially abutting relationship to at least one adjacent cleat node. Each of the cleat nodes has a distal end spaced from the main sole surface and first and second edges on opposite sides of the distal end. The edges having proximal ends which terminate substantially on the circular path.

The first and second edges, sometimes referred to herein as leading and trailing edges because of their relationship to the cleat node and the ground during pivoting, function to cut into the turf, thereby reducing initial resistance to penetration by the cleats. The inventive sole thereby exhibits excellent initial penetration as well as traction and pivotability.

In a first preferred embodiment, adjacent pairs of cleat nodes are arranged to be in substantial abutment at the base portion of the nodes, that is, where the cleat nodes join the main sole surface. In a second preferred embodiment, cleats abut at the shoulder, that is, at a region generally midway between the base portion and the distal end (or "tip") of the cleat. This second embodiment is somewhat more "aggressive" than the first embodiment in its ability to maximize traction. Nevertheless, its configuration exhibits substantially the same advantages as described above with respect to the first embodiment. In a third embodiment, cleat nodes abut at their distal ends tips. As used herein, the expression "substantially abutting relationship" means any one of the foregoing relationships. The term also describes the relationship of cleat nodes which may be slightly spaced from one another at their base portions, or any combination of the foregoing.

A preferred feature of the second embodiment is that the cleat nodes located on the circular path in a position adjacent to the arch portion of the sole are in abutment at their base portions rather than at the shoulder portions, as with the other cleat nodes of such embodiment. The resulting V-shaped spaces between cleat nodes in this area extend from the cleat tips to the sole surface and help prevent the sole from adhering to the turf by suction, as might otherwise occur on a muddy field. Such spaces allow air venting to help prevent the "clapping" sound which can result from trapped air, particularly when a player is running backwards.

All non-cleated areas of that portion of the sole area enclosed by the circular path are preferably coincident with the main sole surface; that is, such surfaces are not built up. This allows full turf penetration by the cleats.

Each of the cleat nodes has a base portion joined to the main sole surface. The base portion of each cleat node has a length measured generally along the circular path of the cleat set and a thickness measured generally radially to such path. The length is substantially greater than the thickness, thus providing excellent pivotability of the sole with good resistance to forces urging the sole laterally or longitudinally.

Controlling the relative length and thickness as described results in a cleat which presents a relatively small frontal area when the sole is being pivoted, thereby reducing pivoting effort. In contrast, the circumferential profile of the cleat nodes is quite large, thereby providing a high degree of stability and traction.

In a highly preferred embodiment, the cleat nodes are tapered to blunt, rather than pointed, distal ends. This configuration optimally resolves the conflicting concerns relating to ease of penetration on the one hand and avoidance of player "spiking" injuries on the other.

In a highly preferred embodiment, each cleat node has multiple planar surfaces and leading and trailing edges each formed by the acute-angle intersections of pairs of such planar surfaces. The leading and trailing edges are substantially coincident with a projection of the circular path and form acute angles with the main sole surface. The resulting cleat node edges facilitate initial ground penetration. In addition, these edges slice rather than "punch" through the turf as the sole is pivoted.

Because of the abutting relationship of the cleat nodes and the angular arrangement of the edges, some highly desirable results are accomplished. First, resistance to initial penetration increases gradually rather than instantaneously as the cleat node first contacts and then penetrates the turf. Second, only slight pivoting rotation of the sole causes a trailing cleat node to enter and follow a path cut by a leading cleat node; therefore, there is a reduction in resistance to pivoting movement following slight initial resistance during initial rotation.

In addition, the unique design of the inventive sole tends to preserve rather than destroy turf. The structural integrity of the earth beneath the sole tends to be preserved and good traction is maintained rather than reduced.

In order to maximize the stability of the sole against lateral forces, the outer surface of at least one of the cleat nodes is generally coincident with the lateral side portion of the sole. An outer surface of at least one other cleat node is generally coincident with the medial side portion of the sole. Stated another way, the cleat nodes on the medial side and lateral side portions of the soles preferably have maximum spacing therebetween. This helps reduce the possibility or the severity of ankle-twist injuries.

To help assure that the athlete enjoys excellent sole flexibility in the ball-of-the-foot and toe portions, it is preferred that the cleat nodes be arranged to promote such flexibility while yet maintaining a good capability for stopping, starting and cutting. In certain embodiments of this invention, each adjacent pair of abutting, tapered cleat nodes defines a generally V-shaped space between them. The annular cleat set includes a plurality of opposed pairs of such spaces forming a plurality of cross-sole breaks in the annular cleat set.

The configuration of the inventive athletic shoe sole and of the cleat nodes forming a part of the sole may be readily adapted to accommodate specific requirements. For example, the angles of taper of leading and trailing edges may be changed, the degree of sharpness of such edges may be modified and/or the cleat tip may be more or less blunted or pointed.

In some cases, it may be desirable to taper cleat nodes non-uniformly so that the profiles of the leading edges are different than the profiles of their trailing edges. This would serve to make pivoting easier in one direction than another, which may be desirable for athletes playing certain positions. Varying sharpness of leading and trailing edges can provide the same result.

Little or no spacing between cleat nodes is highly preferred. In such cases, there is little if any of the main sole portion lying exposed along the circular path followed by the annular cleat set. Thus, the cleat set of this invention, for all practical purposes, forms a substantially continuous ring despite the characteristics of the cleat nodes therealong.

BRIEF DESCRIPTION OF THE DRAWINGS

FIG. 3 is a bottom plan view of a cleat node.

FIG. 4 is an end elevation view of the cleat node of FIG. 3, taken along the viewing axis 4 of FIG. 3.

FIG. 5 is a side elevation view of the cleat node of FIG. 3, taken along the viewing axis 6 of FIG. 3.

FIG. 6 is a side elevation view of the cleat node of FIG. 3, taken along the viewing axis 6 of FIG. 3.

FIG. 8 is a bottom plan view of cleat nodes arranged in an abutting relationship at their distal ends as used in a third embodiment of the invention.

DETAILED DESCRIPTIONS OF PREFERRED EMBODIMENTS

The figures illustrate a preferred athletic shoe sole 10 in accordance with this invention.

Figure 2:
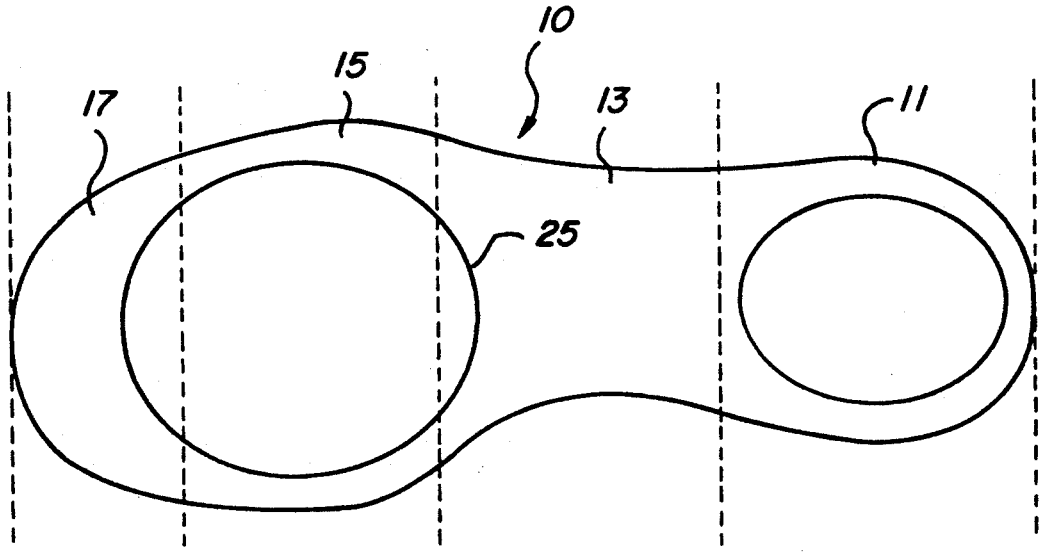
FIG. 2 is a bottom plan view of the sole of FIG. 1, with cleat sets removed, showing the heel, arch, ball-of-the-foot and toe portions of the sole.

Referring first to FIG. 2, the sole 10 has four portions which are defined by the portions of the foot adjacent to them. These sole portions are: the heel portion 11; the arch portion 13; the ball-of-the-foot portion 15; and the toe portion 17. The upper portions of the shoe are not illustrated.

Figure 1:
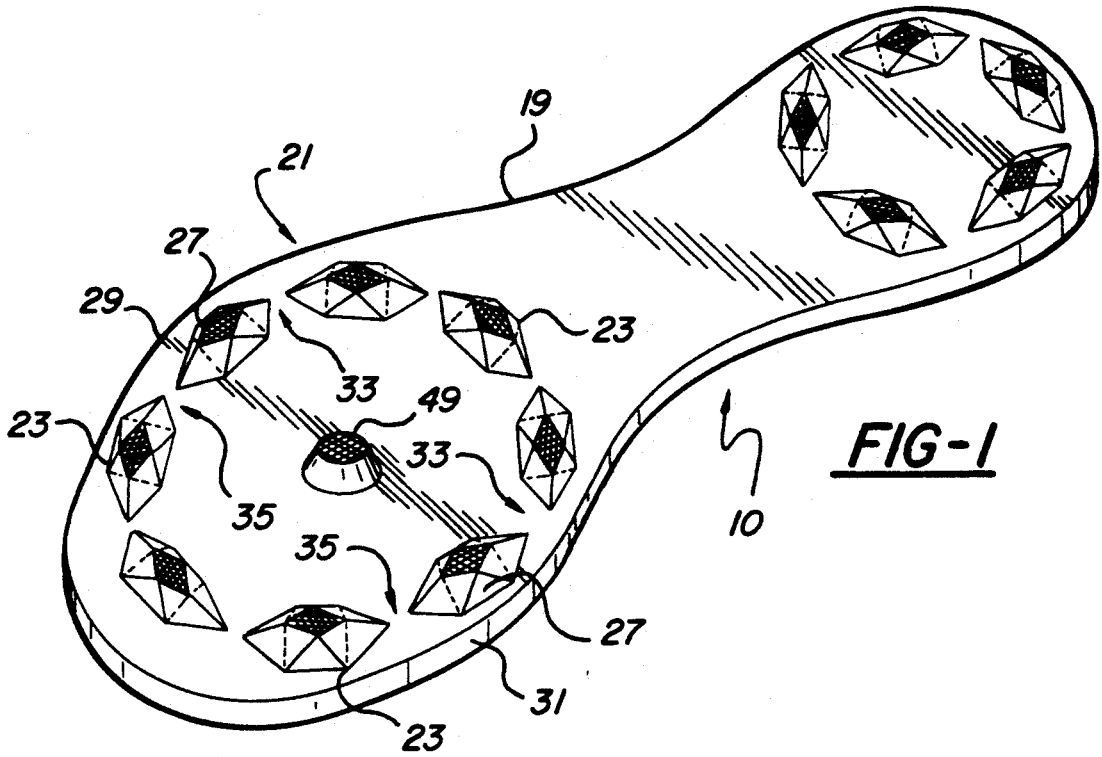
FIG. 1 is a perspective view of the first embodiment of the invention.

Referring now to FIG. 1, the lower surface of the sole 10, which contacts the surface of the playing field, includes a main sole surface 19 which is a generally flat, even surface from which an annular cleat set 21 projects. The cleat set 21 has a number of cleat nodes 23 which are integrally formed with the main sole surface 19 in a molding process of well-known type. The sole 10 is made of material which is tough and wear resistant but which can flex in the normal manner depending upon how weight is applied to it. The sole 10 is preferably formed of polyurethane or rubber.

A plurality of cleat nodes 23 project from the main sole surface 19 and are disposed along a substantially circular path 25. This path 25 encompasses a major area of toe and ball-of-the-foot portions 17 and 15, respectively, and is centered on the juncture of such portions. Each cleat node 23 is arranged in a substantially abutting relationship to at least one adjacent cleat node 23 for providing improved engagement between the sole 10 and an earthen surface such as turf. Improved engagement results because of the relatively large number of cleat nodes 23 projecting from the sole 10, among other things.

For sports involving frequent and sudden shifts in body position or direction of movement, it is preferred that the arrangement of the cleat nodes 23 is selected to maximize the lateral stability of the shoe. To that end, an outer surface 27 of at least one of the cleat nodes 23 is generally coincident with the lateral side portion 29 of the sole 10. An outer surface 27 of at least another one of the cleat nodes 23 is generally coincident with the medial side portion 31 of the sole 10. Improved lateral shoe stability results and this feature aids in avoiding ankle injuries or in lessening their severity.

It is also preferred that the sole 10 exhibit a high degree of cross-sole flexibility, particularly at and near the junction of toe and ball-of-the-foot portions, 17 and 15, respectively. Accordingly and in the first and second embodiments, shown in FIGS. 1 and 7 respectively, a first opposed pair of V-shaped spaces 33 defines one break (or flexing line or region) and a second opposed pair of V-shaped spaces 35 defines another break located forward of the first. The flexibility of the sole 10 is thereby preserved while yet maintaining an excellent traction capability.

Referring next to FIGS. 3, 4, 5 and 6, a preferred cleat node 23 is shown to include a base portion 37, a distal end or tip 39 and a shoulder 41 located generally midway between the base portion 37 and the tip 39. Each cleat node 23 includes multiple planar surfaces 43 and edges 45 at the intersections of pairs of such planar surfaces 43. In particular, a cleat node 23 includes a first edge **45*a* and a second edge 45*b*, each formed by the intersection of two planar surfaces 43 having an acute included angle between them. The proximal ends 47 of the first edge 45*a* and second edge 45*b* terminate on the path 25 and each of the edges 45*a*, 45*b* cooperates with the main sole surface 19 to likewise define an acute included angle "A" between them. The tip 39** is a flat surface which is diamond-shaped as shown in FIG. 3. This surface may be smooth or, preferably, cross hatched to a shallow depth for improved traction.

Referring generally to FIGS. 3–5 and particularly to FIGS. 4 and 5, a highly preferred cleat node 23 is tapered in two dimensions D1, D2. A first dimension D1 is measured along the base portion 37 generally parallel to the path 25. It will be appreciated that if measurement is taken in a plane parallel to the path 25 and at progressive points along the first and second edges **45*a*, 45*b*, where the edges 45*a*, 45*b* intersect with the plane the dimension D1 between points on those edges 45*a*, 45*b* diminishes as the points of measurement move upward from the base portion 37 to the tip 39. Similarly and referring particularly to FIGS. 3 and 4, a second dimension D2, cleat node thickness, may be similarly measured generally radially to the path 25 and it will be noted that the thickness of the cleat node 23 also diminishes as the points of measurement are moved upward from the base portion 37 to the tip 39**.

Several benefits arise from the use of a cleat node 23 having the described configuration. Referring particularly to FIGS. 1, 3 and 4, it is apparent that the tip 39 has a relatively small surface area. As the tip 39 first makes contact with the turf, it tends to readily penetrate the turf, especially soft turf. Penetration is aided by the fact that the first and second edges 45a, 45b progressively slice the turf as the depth of penetration increases. This combination of a tip surface with a relatively small area and of first and second edges 45a, 45b exhibiting wedge-like or knife-like characteristics results in good penetration characteristics.

Pivoting movement causes the annular cleat set 21 to move about a center cleat 49 which is located at or near the center of the circular path 25. As a cleat node 23 moves in either direction, its first edge 45a or second edge 45b, whichever is leading, cuts through the turf. The corresponding edge of the adjacent trailing cleat node 23 thereafter enters and follows the path cut by the leading cleat node 23. Pivoting effort is thereby reduced.

Referring especially to FIG. 4, the profile of a cleat node 23 as seen spanning the circular path 25 of the annular cleat set 21 is relatively small and this fact also aids in the ability of the cleat node 23 to more easily advance through the turf as the sole 10 is pivoted.

As explained above, a preferred sole 10 not only facilitates pivoting movement without the imposition of undue stress on the athlete's leg but also provides stability and traction for foot movements not involving pivoting. Referring particularly to FIG. 5, the profile area of a side of the cleat node 23 is relatively large and this provides a substantial surface to resist slipping during stopping, starting, and cutting.

Still another benefit of the described cleat node 23 configuration may be attributed to its tapered shape. That is, its base portion 37 has an area which is significantly larger than that of the surface of the tip 39. This "broad shouldered" configuration makes the cleat node 23 highly resistive to forces which may bend, twist or otherwise deform the cleat node 23 and impair traction.

One of the most difficult of all playing field conditions is presented when very hard earth is covered with wet grass. This most frequently occurs upon the formation of dew. Not only is it difficult to penetrate the ground with any sort of cleat configuration, but conventional smooth-surfaced, conical cleats have a low coefficient of friction in contact with wetted grass. With the annular cleat sets 21 described herein, the multiple edges 45 on each cleat node 23 combined with an arrangement of cleat nodes 23 in an abutting relationship, with or without V-shaped spaces 35 therebetween, helps "tangle" with blades of grass. Improved traction results.

With respect to the first embodiment, it should also be appreciated that during rare but very strenuous movements, the sole 10 may become severely flexed along any line passing through the center cleat 49. Many cleat nodes 23 may not then be in contact with the turf. Even in that event, the sole 10 maintains at least three cleat nodes 23 in turf contact for helping the athlete maintain footing.

Figure 7:
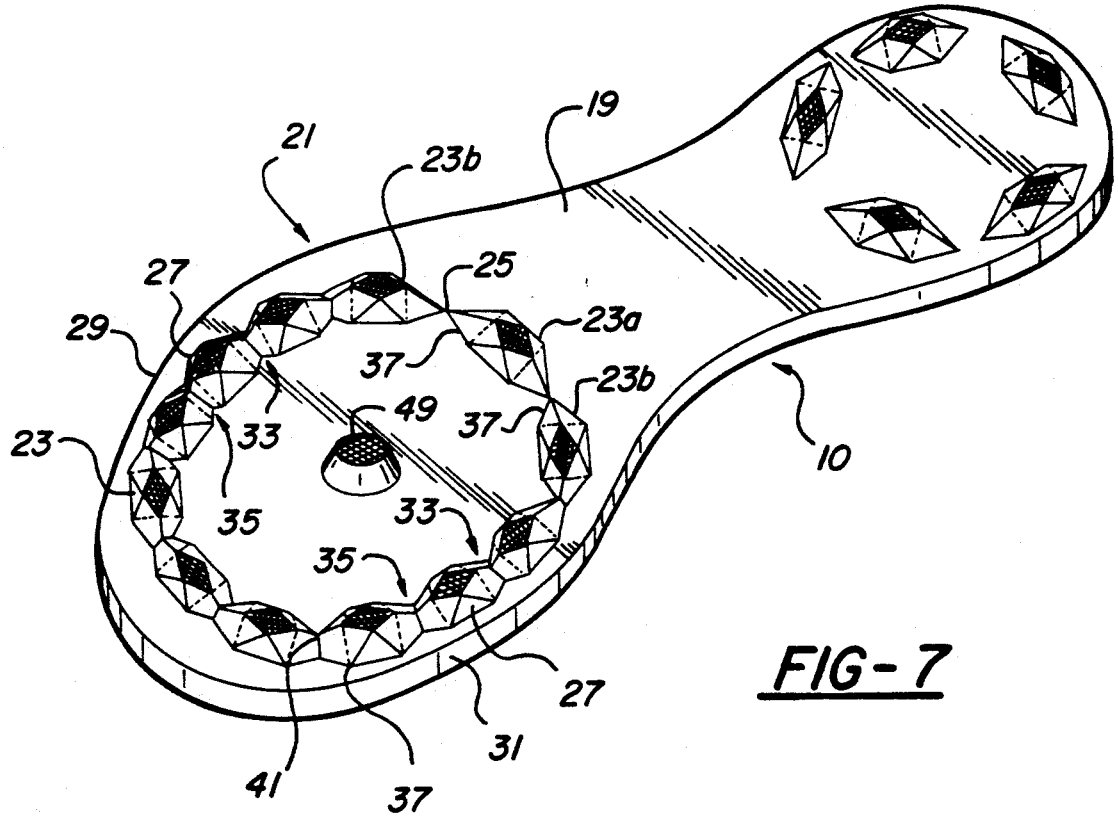
FIG. 7 is a perspective view of the second embodiment of the invention.

Referring next to FIG. 7, a second embodiment of the athletic shoe sole 10 includes cleat nodes 23 arranged in a substantially abutting relationship to at least one adjacent cleat node 23. In the second embodiment and for all but one of the cleat nodes 23, the abutting relationship occurs at the shoulder portion 41 rather than at the base portion 37. For any given size of shoe sole 10, this provides a greater cleat "density" and results in a sole 10 which more aggressively grips the turf. In the embodiments described above, that portion of the main sole surface 19 which is encompassed by the circular path 25 is not built up; that is, it lies generally on the same plane as those portions of the sole surface 19 lying outside the circular path 25.

Referring to FIG. 7, it will be noted that in this second embodiment, most of the cleat nodes 23 abut at the shoulder 41 rather than at the base portion 37. Unless special precautions are taken, air may become entrapped within the space encompassed by the annular cleat set 21, as previously explained. Accordingly, one cleat node 23a, preferably located at the rear part of the circular path 25, is arranged to abut adjacent cleat nodes 23b at the base portion 37 or to be slightly spaced therefrom. This arrangement provides a plurality of air passages to prevent air entrapment.

Yet other arrangements of the inventive athletic shoe sole 10 are possible in view of the foregoing. For example, a sole 10 configured for use on artificial turf may employ concentric rings of cleat nodes 23 at the forefoot, and perhaps also on the heel. Still another variation may involve the use of cleat nodes 23 of slightly different size and/or physical arrangement. For example, cleat nodes 23 may be sized and arranged to define a pair of spaces adjacent the lateral sole portion 29 but only a single space adjacent the medial sole portion 31. The resulting spaces would provide for sole flexibility by defining a "V", the ends of which are at the lateral sole portion 29 and the apex of which is at the medial sole portion 31.

Referring to FIG. 8, a third embodiment involves arranging cleat nodes 23 in an abutting relationship at the tip 39 or distal end. Of the three embodiments, this third embodiment maximizes the area which initially contacts the turf and the area forming the bearing surface during pivoting movement. Therefore, this third embodiment has the least resistance to pivoting effort. However, the presence of its multiple edges 45 in engagement with the turf, including wet grass, provides improved traction over earlier shoe soles.

While the principles of this invention have been described in connection with specific embodiments, it should be understood clearly that these descriptions are made only by way of example and are not intended to limit the scope of the invention.

I claim:

1. In a cleated field-sports shoe sole of the type having ground-penetrating cleats extending from a main sole surface, and having heel, arch, ball-of-the-foot and toe portions, the improvement comprising:

an annular cleat set projecting from the main sole surface and disposed along a substantially circular path encompassing a major area of the toe and ball-of-the-foot portions, the set having a plurality of cleat nodes each arranged in a substantially abutting relationship to at least one adjacent cleat node;

each cleat node having a base portion which is joined to the main sole surface and has a length measured generally along the path and a thickness measured generally radially to the path, the length substantially greater than the thickness, whereby the cleat set provides excellent pivotability of an cleated field-sports shoe and excellent resistance to forces urging the shoe laterally or longitudinally;

each cleat node having a distal end spaced from the main sole surface and first and second edges on opposite sides of the distal end, each of the edges having a proximal end which terminates substantially on the circular path and, when the cleat node is in contact with the ground, defines with the ground an acute included angle thereby to reduce resistance of the sole to pivoting action; and each cleat node having a shoulder portion intermediate the distal end and the main sole surface, said abutting relationship occurring at the shoulder portions of abutting cleat nodes.

2. In a cleated field-sports shoe sole of the type having ground-penetrating cleats extending from a main sole surface, and having heel, arch, ball-of-the-foot and toe portions, and opposite lateral and medial side portions, the improvement comprising:

an annular cleat set projecting from the main sole surface and disposed along a substantially circular path encompassing a major area of the ball-of-the-foot and toe portions, the set having a plurality of cleat nodes;

each cleat node tapered in two dimensions, a first dimension measured generally parallel to the path and a second dimension measured generally radially to the path, thereby providing a tip of reduced area;

each of the cleat nodes further including multiple substantially planar surfaces and edges at the intersections of pairs of such planar surfaces;

at least one of said cleat nodes having a radially-outer surface which is generally coincident with the medial side portion and at least one other of said cleat nodes which has a radially-outer surface generally coincident with the lateral side portion;

each adjacent pair of tapered cleat nodes defining a generally V-shaped space therebetween, a plurality of opposed pairs of the spaces forming a plurality of cross-sole breaks in the annular cleat set; and each of the cleat nodes further including a shoulder portion located intermediate the tip and the main sole surface, each cleat nodes being arranged in a substantially abutting relationship to at least one adjacent cleat node, such abutting relationship occurring at the shoulder portions of abutting cleat nodes.

3. The cleated field-sports shoe of claim 1, wherein said abutting relationship between said cleat nodes located towards the rear of said ball-of-the-foot portion occurs at the base portion of said cleat nodes.

* * * * *